US010501930B1

(12) United States Patent
Hyett et al.

(10) Patent No.: US 10,501,930 B1
(45) Date of Patent: Dec. 10, 2019

(54) DECK CONNECTOR

(71) Applicants: Mark Hyett, Malta, OH (US); Brittney Hyett, Malta, OH (US)

(72) Inventors: Mark Hyett, Malta, OH (US); Brittney Hyett, Malta, OH (US)

( * ) Notice: Subject to any disclaimer, the term of this patent is extended or adjusted under 35 U.S.C. 154(b) by 0 days.

(21) Appl. No.: 16/183,922

(22) Filed: Nov. 8, 2018

(51) Int. Cl.

| | |
|---|---|
| ***E04B 1/58*** | (2006.01) |
| ***E04B 1/41*** | (2006.01) |
| ***E04B 1/00*** | (2006.01) |
| *E04B 1/38* | (2006.01) |

(52) U.S. Cl.
CPC ..... *E04B 1/40* (2013.01); *E04B 1/003* (2013.01); *E04B 1/58* (2013.01); *E04B 2001/405* (2013.01)

(58) Field of Classification Search
CPC ... E04B 1/40; E04B 1/58; E04B 1/003; E04B 2001/405
USPC .... 52/287, 586.2, 747.11, 282.1, 282.4, 762, 52/764, 765
See application file for complete search history.

(56) References Cited

U.S. PATENT DOCUMENTS 2,406,387 A * 8/1946 Lank ..... F16B 12/18 144/347
2,618,028 A * 11/1952 Baker ..... E04C 2/043 52/241
3,235,039 A * 2/1966 O'Donnell ..... E04B 2/90 52/235
4,457,115 A * 7/1984 Grearson ..... E04B 5/40 52/250
5,758,467 A * 6/1998 Snear ..... E04C 2/20 52/177
5,822,936 A * 10/1998 Bateman ..... E04H 9/10 52/281
6,032,431 A * 3/2000 Sugiyama ..... E04B 1/2604 52/656.9
D427,050 S 6/2000 Bryan
6,402,415 B1 * 6/2002 Eberle, III ..... E04F 13/0846 403/231
D485,160 S * 1/2004 Pelc ..... E04F 15/04 D8/382
6,810,633 B2 * 11/2004 Harris, Sr. ..... E04B 5/12 52/489.2
6,851,884 B2 * 2/2005 Eberle ..... E04F 15/04 403/231
7,052,200 B2 * 5/2006 Harris ..... E04F 15/04 403/231
7,578,105 B2 * 8/2009 Eberle, III ..... E04F 15/04 403/231
D600,105 S * 9/2009 Harris ..... D8/382
7,805,898 B1 * 10/2010 Everitt ..... E06B 9/02 49/50
7,874,113 B2 * 1/2011 Eberle, III ..... E04F 15/04
8,161,702 B2 * 4/2012 Eberle, III ..... E04F 15/04
9,003,624 B2 4/2015 Wadsworth
(Continued)

*Primary Examiner* — Brent W Herring
(74) *Attorney, Agent, or Firm* — Sanchelima & Associates, P.A.; Christian Sanchelima; Jesus Sanchelima

(57) ABSTRACT

A deck connector for coupling deck boards is disclosed. The deck connector comprises a frame comprising holes and first openings. The first openings are provided near ends of the frame. The deck connector further comprises an arm extending over the length of the frame. The arm is coupled to the frame perpendicularly. The arm comprises a plurality of cut sections provided in axis with the first openings at the frame. The arm and frame are used to couple and secure the deck boards.

4 Claims, 4 Drawing Sheets

(56) References Cited

U.S. PATENT DOCUMENTS

D732,941 S * 6/2015 Erickson ..... D8/381
9,484,853 B2 * 11/2016 Stapleton ..... H02S 20/23
9,700,931 B2 * 7/2017 Wadsworth ..... E04F 15/02
9,806,667 B2 * 10/2017 Stapleton ..... H02S 20/23
9,868,147 B2 * 1/2018 Wadsworth ..... E04F 15/02
10,113,306 B2 * 10/2018 Brigham ..... E04B 1/003
2003/0159399 A1 * 8/2003 Werren ..... E04F 21/0092 52/749.1
2004/0020152 A1 * 2/2004 Harris, Sr. ..... E04B 5/12 52/582.1
2004/0182034 A1 * 9/2004 Eberle, III ..... E04F 15/04 52/586.1
2005/0063771 A1 * 3/2005 Harris ..... E04F 15/04 403/294
2008/0279654 A1 * 11/2008 Deschamps ..... E04F 15/02 411/457
2009/0282771 A1 * 11/2009 Gibson ..... E04F 15/02 52/592.1
2011/0123290 A1 * 5/2011 Wadsworth ..... E04F 15/02 411/103
2012/0311952 A1 * 12/2012 Campbell-Lloyd ..... E04B 5/023 52/586.2
2013/0074425 A1 * 3/2013 Miyamoto ..... E04F 13/0839 52/126.7
2013/0104497 A1 * 5/2013 Ross ..... E04F 21/185 52/749.11
2015/0202678 A1 * 7/2015 Wadsworth ..... E04F 15/02 29/428
2015/0308098 A1 * 10/2015 Tessadori ..... E04F 13/0807 52/698
2016/0111999 A1 * 4/2016 Stapleton ..... H02S 20/23 52/173.3
2017/0019058 A1 * 1/2017 Stapleton ..... H02S 20/23
2017/0232499 A1 * 8/2017 Wadsworth ..... E04F 15/02 29/428

* cited by examiner

DECK CONNECTOR

BACKGROUND OF THE INVENTION

1. Field of the Invention

The present disclosure generally relates to deck connectors. More particularly, the present disclosure relates to a deck connector used for coupling wooden or metal walls for preventing warping and splitting of the wall.

2. Description of the Related Art

It is known that decks are popular feature in many houses. The decks may be constructed as a flat surface capable of supporting weight, which is similar to a floor, and is typically constructed outdoors. Another example includes construction of decks in the form of walls in suitable height to form a fence-like structure. In order to construct decks, a plurality of wooden parts or sheet metal is coupled in a series or parallel to form the deck. For connecting two or more parts, conventionally nails were used.

With improvement in field of construction, a deck connector made of metal such as aluminum has been used in place of nails when laying out wooden deck materials. Deck connectors are preferred over nails for safety and durability. This is because; when the deck connector is used, the nails used for coupling the deck connector to the deck won't stick out of the surface. Further, the deck connectors are made up of stainless steel, which is rust-resistant and has a good leakage prevention capability. Furthermore, the deck connectors are preferred for their versatility as they can be used to mount decks in balconies, verandahs, terraces, walkways, wall fence and so on.

Several designs of deck connectors have been proposed in the past. One such example is disclosed in a U.S. Pat. No. 9,003,624. In U.S. Pat. No. 9,003,624, a gangable composite clip for attaching decking is disclosed. The clip includes a bottom and a top. The bottom is made of a first material. The top is made of a second material. The first material of the bottom engages in the second material of the top during manufacturing so as to attach the bottom to the top and form the gangable composite clip without a need for any other means to attach the bottom to the top.

Another example of deck connector is disclosed in a U.S. Design Pat. No. D427050S. In U.S. Pat. No. D427050S, a T-shaped deck connector is disclosed.

Although the deck connectors discussed above and other known connectors are used to couple the decks, they have several problems. This is because; the decks or boards are exposed to tough weather conditions. As a result, the wood may expand or shrink and causes the deck to warp. Further, the decks or boards are often constructed improperly. As a result, the decks may split over a period of time.

Other documents describing the closest subject matter provide for a number of more or less complicated features that fail to solve the problem in an efficient and economical way. None of these patents suggest the novel features of the present invention. Specifically, none of the disclosures in the art disclose a deck connector provided in a T-shape, which makes it easy to couple decks and prevents splitting and warping of the decks.

Therefore, there is a need in the art for a deck connector provided in a T-shape, capable of preventing splitting and warping of decks.

SUMMARY OF THE INVENTION

It is one of the main objects of the present invention to provide a deck connector in a T-shape and avoids the drawbacks of the prior art.

It is one object of the present invention to provide a deck connector for coupling deck boards. The deck connector comprises a frame comprising holes and first openings. The first openings are provided near ends of the frame. The deck connector further comprises an arm extending over the length of the frame. The arm is coupled to the frame perpendicularly. The arm comprises a plurality of cut sections provided in axis with the first openings at the frame. The arm and frame are used to couple and secure the deck boards.

It is another object of the present invention to provide the frame having more length than the deck board.

It is another object of the present invention to provide the deck connector made up materials such as aluminum to prevent it from rusting and to stop warping of the deck board as it ages.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a deck connector for coupling deck boards. The deck connector comprises a frame comprising holes and first openings. The first openings are provided near ends of the frame. The deck connector further comprises an arm extending over the length of the frame. The arm is coupled to the frame perpendicularly. The arm comprises a plurality of cut sections provided in axis with the first openings at the frame. The arm and frame are used to couple and secure the deck boards.

Various features and embodiments of a deck connector are explained in conjunction with the description of FIGS. 1-6A.

Figure 1:
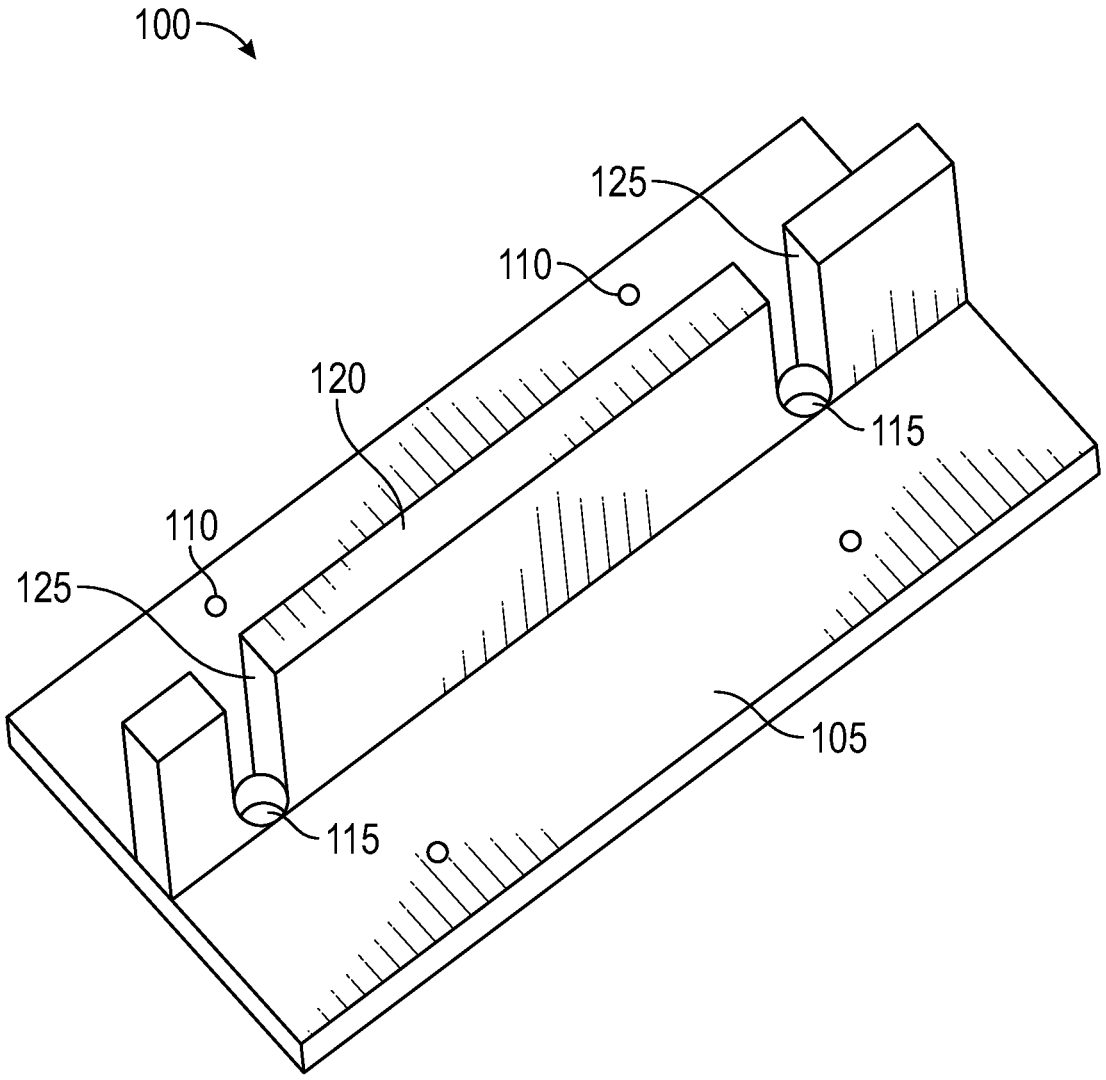
FIG. 1 illustrates a perspective view of a deck connector 100, in accordance with one embodiment of the present disclosure.

Referring to FIG. 1, a perspective view of a deck connector 100 is shown, in accordance with one embodiment of the present disclosure. The deck connector 100 comprises a frame 105 provided in a flat structure. The frame 105 may be made up of plastic, wood, metal such as aluminum or any other suitable material. The frame 105 may be provided in a square, rectangle or any other shape. In one example, the frame 105 is provided with a plurality of holes 110. The plurality of holes 110 may be used to couple the frame 105 to a structure with the help of fasteners (not shown). Further, the frame 105 is provided with first openings 115. In one example, the first openings 115 are provided near ends of the frame 105.

Further, the frame 105 further comprises an arm 120 extending from the frame 105. It should be understood that the arm 120 is provided in perpendicular to the frame 105, thereby forming a T-shape structure. In accordance with embodiment of the present embodiment, the frame arm 120 is provided with cut sections 125 as shown in FIG. 1. Specifically, the cut sections 125 are provided in axis with the first openings 115 provided at the frame 105.

Figure 2:
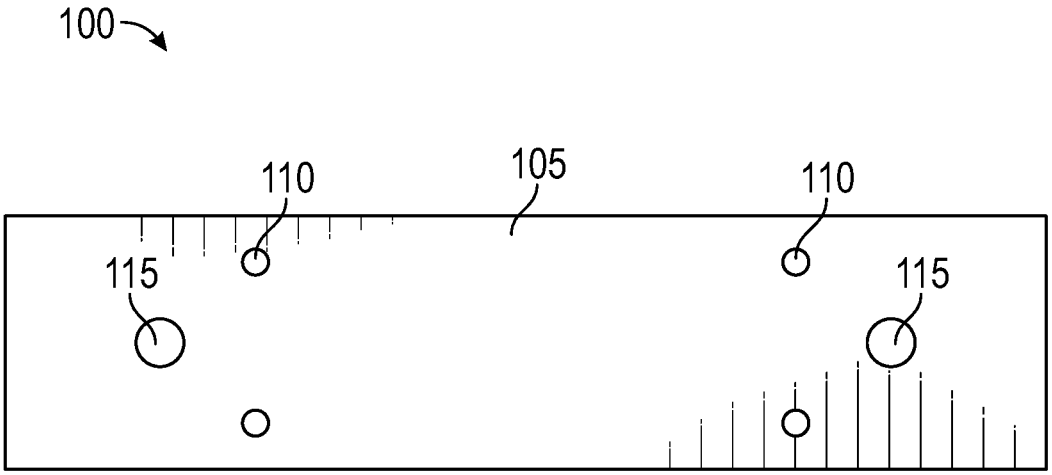
FIG. 2 illustrates a rear view of the deck connector 100.

Referring to FIG. 2, a rear view of the deck connector 100 is shown, in accordance with one embodiment of the present disclosure. As can be seen, the deck connector 100 comprises the plurality of holes 110 and the first opening 115.

Figure 3:
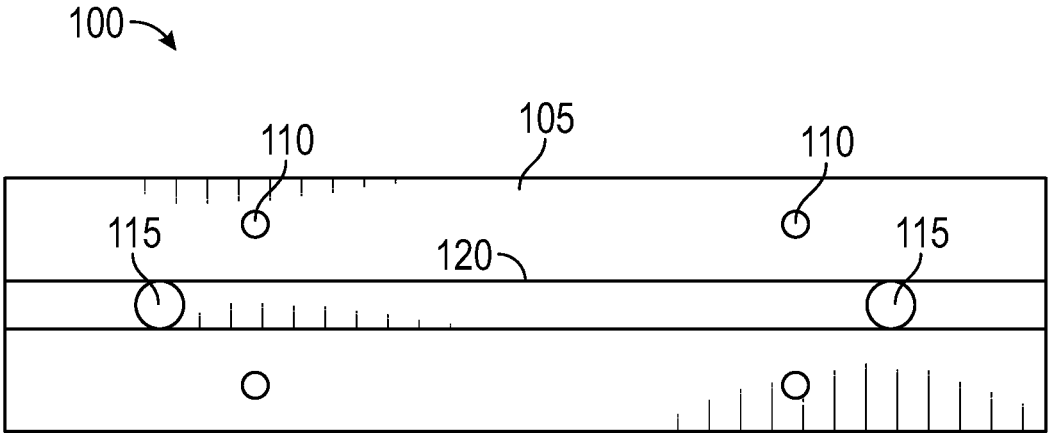
FIG. 3 illustrates a front view of the deck connector 100.

Further, referring to FIG. 3, a front view of the deck connector 100 is shown. As can be seen, the deck connector 100 comprises the plurality of holes 110, the first opening 115 and the arm 120.

Figure 4:
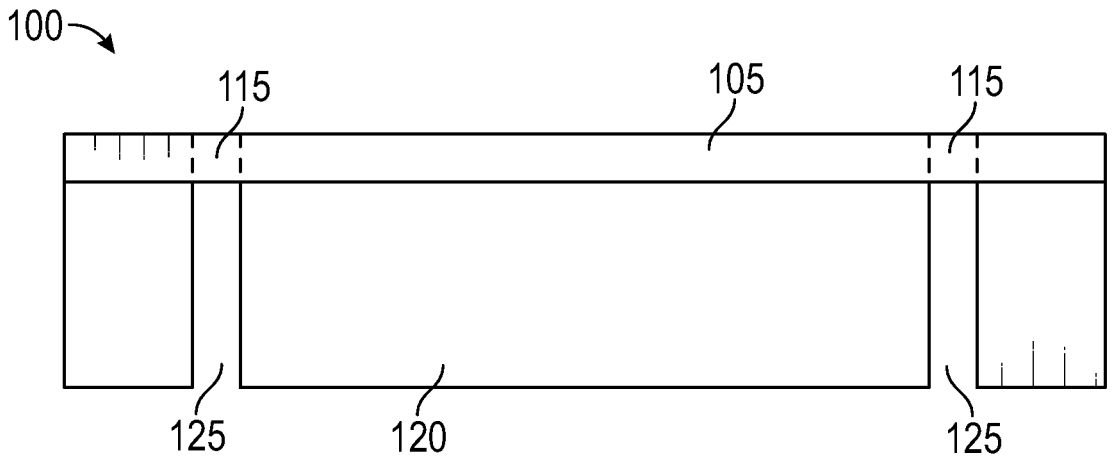
FIG. 4 illustrates a side view of the deck connector 100.
Figure 5:
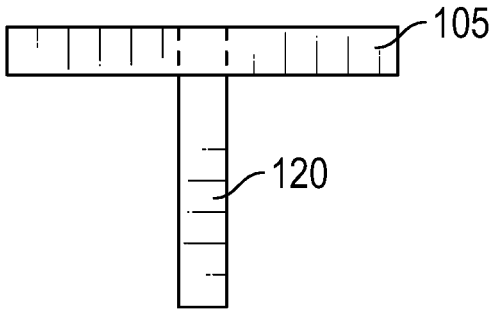
FIG. 5 illustrates an end view of the deck connector 100.

FIG. 4 shows a side view of the deck connector 100. FIG. 4 is provided to show the cut sections 125 provided in axis with the first openings 115 at the frame 105. Further, FIG. 5 shows an end view of the deck connector 100 comprising the frame 105 and the arm 120.

Figure 6:
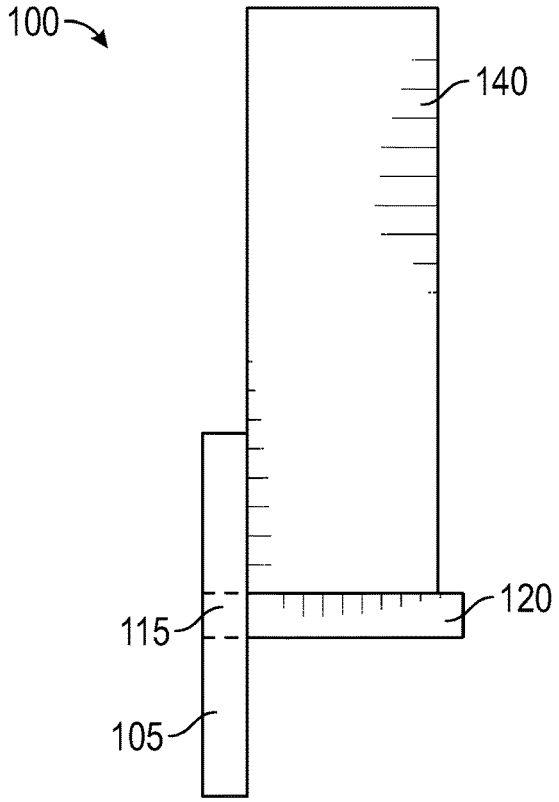
FIG. 6 illustrates a side view of the deck connector 100 coupled to a deck board 140, in accordance with one embodiment of the present disclosure.
Figure 6A:
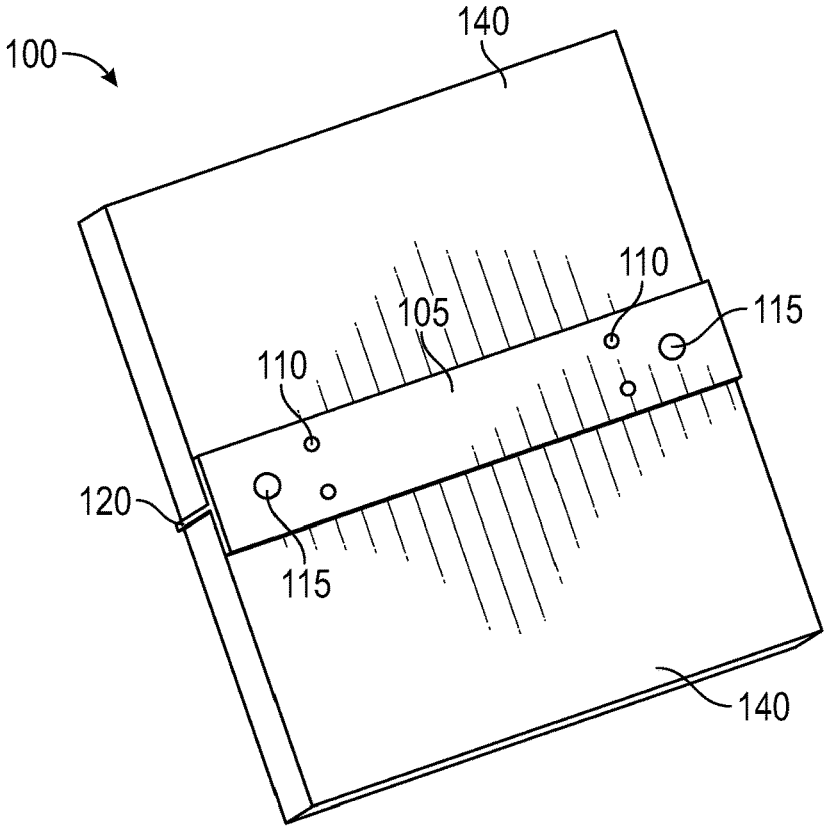
FIG. 6A illustrates a perspective view of the deck connector 100 coupled to the deck boards 140, in accordance with an exemplary embodiment of the present disclosure.

Now referring to FIGS. 6 and 6A, the deck connector 100 used for coupling and securing deck boards 140 is shown, in accordance with one exemplary embodiment of the present disclosure. As can be seen, FIG. 6 shows a side view of the deck connector 100 used to couple a deck board 140. In order to couple the deck board 140 to the deck connector 100, at first, the deck board 140 is coupled to the arm 120. Subsequently, a plurality of fasteners (not shown) is inserted through the holes 110 and the deck board 140. Alternatively, a plurality of fasteners (not shown) is inserted in the cut sections 125 parallel to the frame 105 to secure the deck board 140 to the arm 120.

Referring to FIG. 6A, a perspective view of the deck connector 100 used for coupling or connecting deck boards 140 is shown. As explained above, the deck boards 140 are coupled to the frame 105 with the help of the arm 120, and the cut sections 125.

Due to construction of the deck connector 100, the deck boards 140 may be constructed properly. In other words, the holes 110 and the first openings 115 do not over-drive the fasteners into the deck boards 140. As a result, splitting of the deck boards 140 can be prevented. In addition, the deck connector 100 is selected to have more length than the deck boards 140 to prevent warping of ends of the deck boards 140. This is particularly helpful when the deck boards 140 are used for a long time. As specified above, the deck connector 100 may be made up of aluminum. As a result, the deck connector 100 may not rust and facilitates in preventing warping of the deck board 140.

In one exemplary embodiment, a sealant (not shown) may be used to couple the frame 105 to the deck boards 140. The sealant may slow down drying process of the deck boards 140 and slow expansion and shrinking of the deck boards 140 thereby preventing the warping and splitting or cracking of the deck boards 140.

It is evident from the above disclosure that the deck connector might be used to couple and secure the deck boards. As such, the deck connector can be used in new construction or repair of old deck boards. The deck connector may be made up suitable material such aluminum or other metals that are known in the art. Further, the length of the deck connector may be selected based on the need. Furthermore, the drawings are provided for illustrative purpose only and should not be construed to limit the scope of the present disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A deck connector for coupling deck boards, comprising:

a frame comprising a rectangular shape;

an arm extending longitudinally over the entire length of the frame, wherein the arm is mounted to said frame and extends perpendicularly therefrom, wherein said arm comprises a rectangular shape, wherein said arm is disposed along the middle of said frame, each end of said arm being flush with said frame said arm includes a first lateral section having a first sectional length, a middle section having a second sectional length, and a second lateral section having a third sectional length, said second sectional length is greater than the combination of said first and third sectional lengths, said middle section is located in between and in line with said first and second lateral sections, said first lateral section, said second lateral section, and said middle section all having the same height; and a first cut section and a second cut section provided along said arm, wherein each of said first and second cut sections is provided in axis with a respective opening, wherein each cut section is of a suitable shape to cooperate with the respective opening, each cut section includes a top end and a bottom end, wherein each cut section extends entirely from the top end to the bottom end, said first cut section located between said first lateral section and said middle section, said second cut section located between said second lateral section and said middle section, wherein each respective opening is located at the bottom end of the respective first and second cut sections, the openings being throughholes;

a first set and a second set of frame throughholes located on said frame, said first set divided from said second set by said arm, said first set located adjacent to a first periphery of said frame and said second set located adjacent to a second periphery of said frame, said first and second peripheries being opposite eachother, said arm and said frame mounted to each other to create a T-shape, wherein the deck boards are placed over the arm and coupled to the frame to secure the deck boards.

2. The deck connector of claim 1, wherein the length of the frame is more than the length of the deck board.

3. The deck connector of claim 1, wherein the frame or the arm is coupled to the deck board using a fastener.

4. The deck connector of claim 1, wherein the frame or the arm is coupled to the deck board using a sealant.

* * * * *